US005501892A

United States Patent [19]

Ohtsubo

[11] Patent Number: 5,501,892

[45] Date of Patent: Mar. 26, 1996

[54] CERAMIC PARTS HAVING SMALL HOLE(S) AND METHOD OF MANUFACTURING THE SAME

[75] Inventor: Shinji Ohtsubo, Nagoya, Japan

[73] Assignee: NGK Insulators, Ltd., Japan

[21] Appl. No.: 356,545

[22] Filed: Dec. 15, 1994

Related U.S. Application Data

[63] Continuation of Ser. No. 269,626, Jul. 1, 1994, which is a continuation of Ser. No. 35,803, Mar. 23, 1993, abandoned.

[30] Foreign Application Priority Data

Mar. 25, 1992 [JP] Japan ..... 4-67649
Mar. 30, 1992 [JP] Japan ..... 4-73853

[51] Int. Cl.[6] ..... C04B 38/00

[52] U.S. Cl. ..... 428/131; 428/141; 428/192; 428/698; 428/702; 428/34.4; 416/97 R

[58] Field of Search ..... 428/698, 131, 428/141, 192, 702, 34.4; 416/97 R

[56] References Cited

U.S. PATENT DOCUMENTS

| | | | |
|---|---|---|---|
| 3,619,077 | 11/1971 | Wile et al. | 415/115 |
| 4,318,666 | 3/1982 | Pask | 415/116 |
| 4,384,452 | 5/1983 | Rice | 60/39.182 |
| 4,402,992 | 9/1983 | Liebert | 427/34 |
| 4,433,812 | 2/1984 | Grime | 239/290 |
| 4,671,740 | 6/1987 | Ormiston et al. | 416/241 B |
| 4,743,041 | 12/1988 | Jenkins et al. | 29/121.1 |
| 4,762,464 | 8/1988 | Vertz et al. | 416/97 R |
| 5,039,562 | 8/1991 | Liang | 427/276 |
| 5,223,320 | 6/1993 | Richardson | 428/137 |
| 5,320,721 | 6/1994 | Peters | 204/129.1 |
| 5,342,166 | 8/1994 | Hattori | 415/115 |

FOREIGN PATENT DOCUMENTS

| | | |
|---|---|---|
| 62-144153 | 9/1987 | Japan . |
| 3-58856 | 3/1991 | Japan . |

OTHER PUBLICATIONS

Kikai To Kogu, vol. 33, No. 3, pp. 97–103, 1989.

*Primary Examiner*—A. A. Turner
*Attorney, Agent, or Firm*—Parkhurst Wendel & Rossi

[57] ABSTRACT

In a ceramic part having at least one small hole or both a hollow portion and small hole(s) which extends from the hollow portion to an outside, an edge portion of the small hole(s) is beveled. In a ceramic part having at least one small hole for a cooling mechanism through which a cooling medium is circulated, the surface roughness of an inner surface of the small hole is $R_{max}$ 7 μm or below. Such a ceramic part having at least one small hole has no chipping or edge around the small hole(s) which can cause breakage at high temperatures and under high pressures, and is thus stronger than a conventional ceramic part. Such a ceramic part is suitable for use at a high temperature, for example, at 1000° C. or above, and is particularly suitable as a gas turbine member, such as a turbine blade or a turbine nozzle of a gas turbine.

7 Claims, 11 Drawing Sheets

CERAMIC PARTS HAVING SMALL HOLE(S) AND METHOD OF MANUFACTURING THE SAME

This application is a continuing application of U.S. Ser. No. 08/269,626, filed Jul. 1, 1994, now allowed, which in turn is a continuing application of U.S. Ser. No. 08/035,803, filed Mar. 23, 1993 now abandoned.

BACKGROUND OF THE INVENTION AND RELATED ART STATEMENT

The present invention relates to a ceramic part having at least one small hole as well as a method of manufacturing the same. More particularly, the present invention pertains to a ceramic part having small hole(s) which has neither chipping nor an edge portion and which exhibits excellent strength at high temperatures and under high stresses, as well as a method of manufacturing such a ceramic part.

The ceramic parts according to the present invention is suitable for use as blades (turbine blades and turbine nozzle) of a gas turbine.

Ceramic materials, such a silicon nitride, silicon carbide and partially-stabilized zirconia, are highly heat-resistant, highly wear-resistant, very hard and highly corrosion-resistant, and are thus used as parts of a mechanical components. Due to improvements and adaptation of design, the use of ceramics has been expanding.

In recent years, application of such ceramics to a gas turbine engine, which is a next generation engine, has been drawing attention. Gas turbine engines are rotary engines in which a high-temperature combustion gas is linked directly to a turbine rotor to obtain power. The individual components of the engine other than the combustor, such as a compressor, a turbine rotor and a rotary heat exchanger, are rotary machines. Therefore, gas turbines have advantages in that the exhaust gas thereof is less pollutant, a variety of fuels can be used, and vibrations, noise level and weight of the engine can be reduced.

Although the gas turbine engine has the aforementioned advantages, it has not yet been put into practical use yet because it consumes more fuel than conventional engines. Thus, an improvement in the engine heat efficiency has been the essential issue for the practical application of the gas turbine engine. To achieve an improvement in the engine heat efficiency, an increase in the gas temperature (hereinafter, referred to as a TIT) at the inlet of a turbine is the requirement.

This is the reason why a ceramic gas turbine is the synonym of a gas turbine. Practical application and development of ceramics which are more heat-resistant than heat-resistant alloys have therefore been desired.

However, the use of a ceramic material as a high-temperature gas turbine member under the conditions that TIT exceeds, for example, 1500° C. means that the temperature of the ceramic material partially exceeds 1600° C. The use of a ceramic material under such conditions reduces the strength thereof. Furthermore, due to erosion or corrosion, the reliability and life of the ceramic material as a gas turbine member are reduced.

Under such circumstances, there has been an increasing demand for providing small holes in ceramic parts in order to cool the ceramic part, measure desired data, and so on.

Conventional ceramic parts having small holes are manufactured in the manner described below. After ceramic powder is pressed, the pressed ceramic powder is cold isostatic pressure molded (CIP) and then calcined to remove binder. Thereafter, small holes are formed by dry machining and then the ceramic compact is fired. Alternatively, after firing, the small holes are formed. Normally, small holes are formed by using a drill, ultrasonic waves or a laser.

However, when the small holes are formed by any of the aforementioned methods, a chipped area may be generated around the small hole when the small hole has penetrated the ceramic material. Since a ceramic is a brittle material, generation of chipping greatly reduces the strength thereof, causing breakage at a high temperature and under a high pressure. Particularly, in a ceramic part, such as a combustor nozzle 1 for a ceramic gas turbine, which has a hollow portion 2 and small holes 3 which are opened into the hollow portion 2, as shown in FIG. 5, chipping 4 occurs inside the parts (on the side of the hollow portion), as shown in FIG. 6. Such a chipped area 4 cannot be practically treated, reducing the strength of the ceramic.

Even when no chipping is generated during the formation of the small holes, an edge 5 may be formed around the small hole 3, as shown, in FIG. 7. This leads to generation of chipping and hence breakage of the ceramic due to the stress applied during use.

Furthermore, in a ceramic part having a cooling mechanism which circulates a cooling medium, as the surface roughness of the inner surface of the small hole through which the cooling medium flows increases, the strength of the ceramic greatly reduces because of the brittleness of the ceramic material. When such a ceramic material is used as a component, it may break because of the small hole.

Accordingly, an object of the present invention is to provide a ceramic part having small hole(s) which has neither chipping nor an edge which can cause breakage, and which can thus be strong at high temperatures and under high pressures.

SUMMARY OF THE INVENTION

To achieve the above-described object, the present invention provides a ceramic part comprising a ceramic body having small hole(s), wherein an edge portion of the small hole(s) is beveled.

The present invention further provides a ceramic part comprising a ceramic body having a hollow portion and small hole(s) which extends from the hollow portion to the outside, wherein an edge portion of the small hole(s) is beveled.

The present invention further provides a method of manufacturing a ceramic part having small hole(s), which comprises five steps of molding, forming small hole(s), and treating an end surface of the formed small hole(s). In the first step, a ceramic compact is molded. The small hole(s) is(are) formed after one of molding, calcining, and firing steps. Treating an end surface of the formed small hole(s) is performed after one of the hole-forming step, calcining step, and firing step.

The present invention further provides a method of manufacturing a ceramic part having a hollow portion and small hole(s) which extend from the hollow portion to the outside, which comprises five steps of molding a ceramic compact having a hollow portion, calcining, firing, forming the small hole(s), finishing and the hollow portion so as to have normal dimensions. The small hole(s) is(are) formed after one of the molding, calcining, and firing steps. Finishing the hollow portion is performed after one of the hole-forming step, calcining step, and firing steps.

The present invention further provides a method of manufacturing a ceramic part having a hollow portion and small hole(s) extending from the hollow portion to the outside, which comprises five steps of molding, calcining, firing, forming the small hole(s), and beveling an edge portion of the small hole(s) by passing a wire with a grindstone attached thereto into a small hole from the hollow portion side and then by pulling the portion of the wire which has protruded from the small hole and rotating the wire. The small hole(s) is(are) formed after one of the molding step, calcining step, and firing step. Beveling is formed after one of the hole-forming step, calcining step, and firing step.

The present invention further provides a ceramic part having small hole(s) for a cooling mechanism through which a cooling medium is circulated at a given position of a ceramic body, in which a surface roughness of the inner surface(s) of the small hole(s) is 2 μm≦$R_{max}$≦7 μm.

DETAILED DESCRIPTION OF THE PREFERRED EMBODIMENTS

The present invention will now be described in detail with reference to the accompanying drawings.

Figure 9:
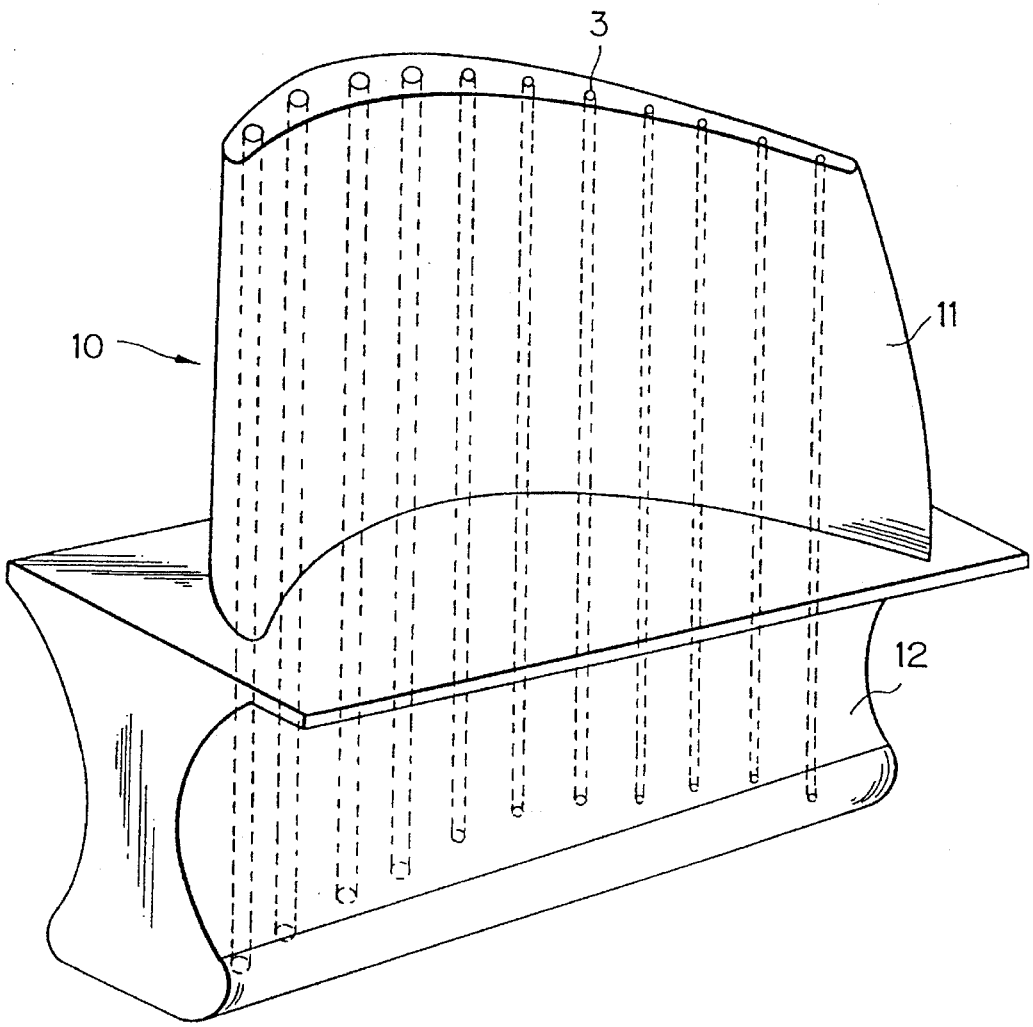
FIG. 9 is a perspective view of a turbine blade of a gas turbine.

In a ceramic part in which small holes 3 are opened to the outer surface thereof, such as a turbine blade 10 of a ceramic gas turbine shown in FIG. 9, the chipping or edge formed around a small hole can be treated by machining the end surface of the small hole after the small hole is formed.

Figure 1A:
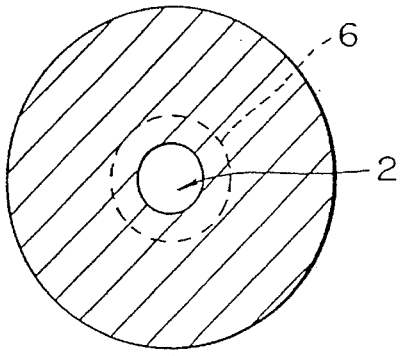
FIGS. 1 (*a*), (*b*) and (*c*) illustrate a method of treating a chipping.
Figure 1B:
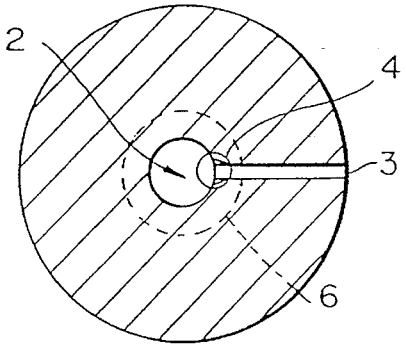
Figure 1C:
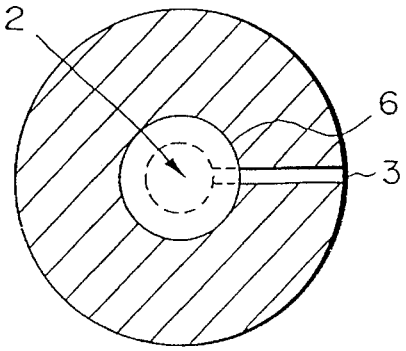
Figure 5:
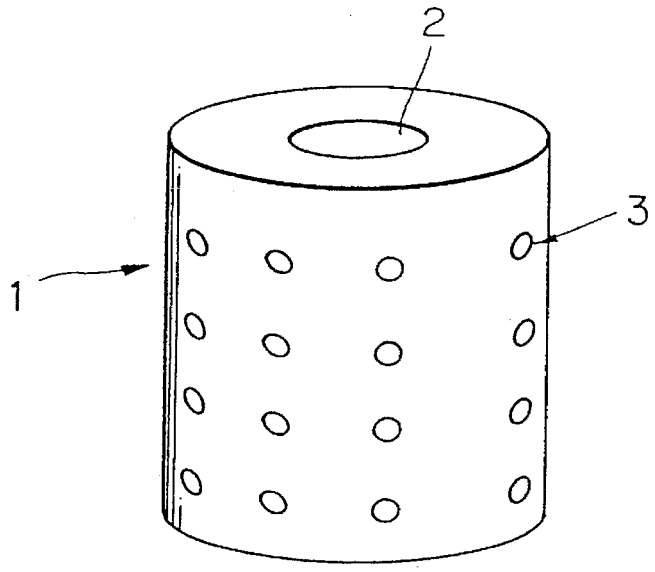
FIG. 5 is a perspective view of a combustor nozzle of a ceramic gas turbine.
Figure 6:
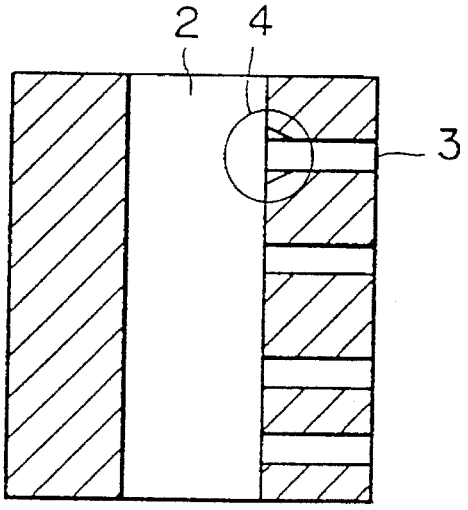
FIG. 6 is a cross-sectional view of the combustor nozzle for the ceramic gas turbine showing how chipping occurs around a small hole.
Figure 7:
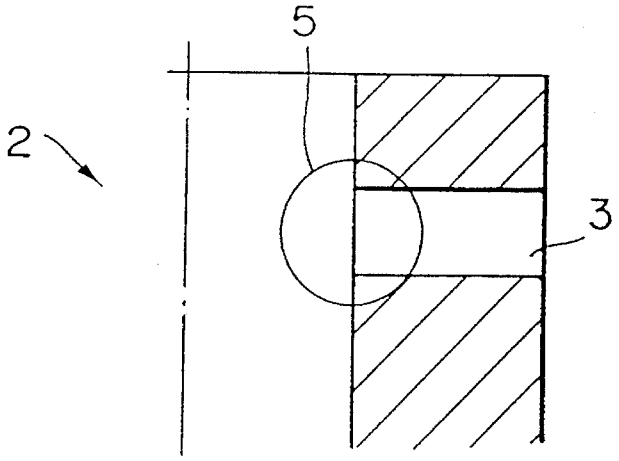
FIG. 7 is a cross-sectional view of a part of the combustor nozzle for the ceramic gas turbine showing how an edge is formed around the small hole.
Figure 8:
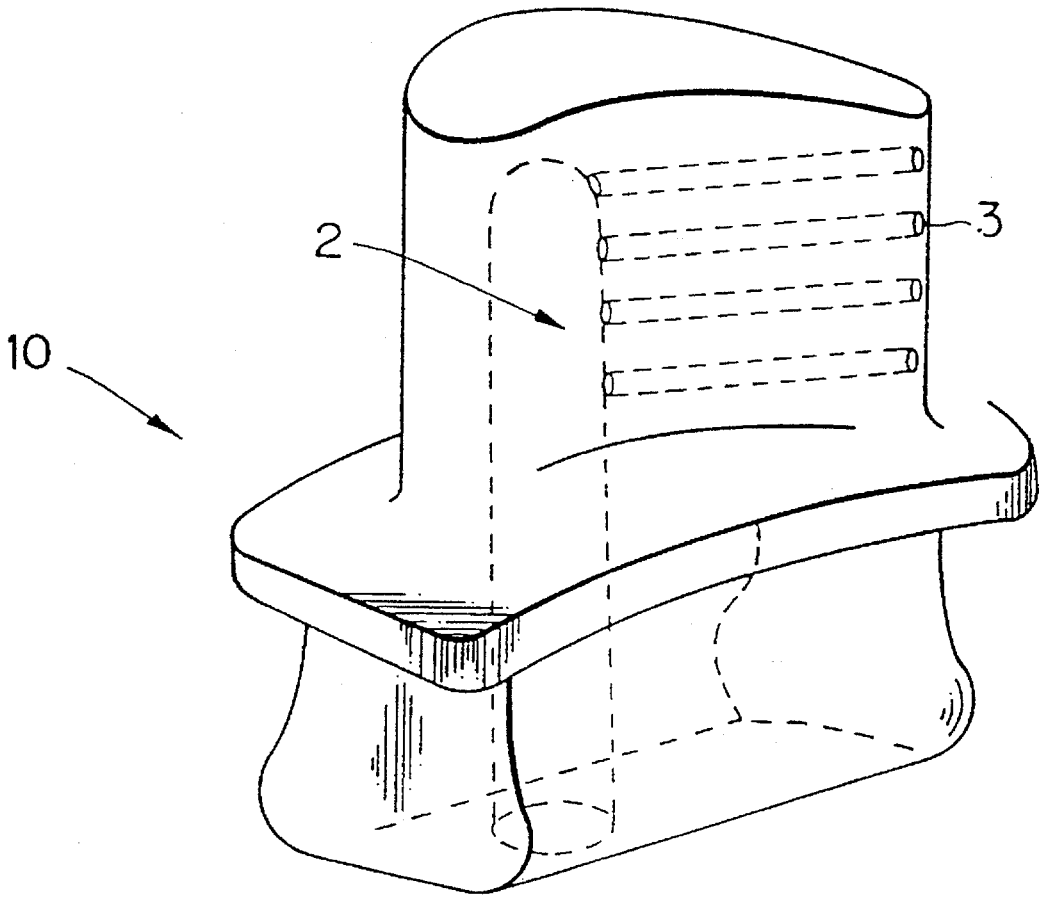
FIG. 8 is a perspective view of a moving blade of a ceramic gas turbine having small holes which extend from a hollow portion to the outside.

In a ceramic part in which the small holes 3 are opened into the hollow portion 2 formed inside thereof, such as a combustor nozzle 1 shown in FIG. 5 or turbine blade 10 of a ceramic gas turbine shown in FIG. 8, a chipped portion 4 can be removed by molding the hollow portion 2 such that it has dimensions smaller than the normal ones 6, as shown in FIG. 1(*a*), by forming the small holes 3, as shown in FIG. 1(*b*), and then by finishing the small holes 3 such that they have the normal dimensions 6, as shown in FIG. 1(*c*).

Figure 2A:
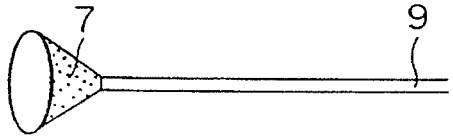
FIGS. 2 (*a*) and (*b*) illustrate a wire with a grindstone attached thereto which is used for beveling.
Figure 2B:
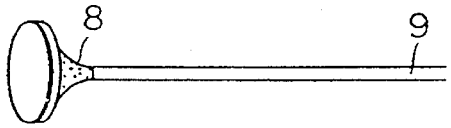
Figure 3:
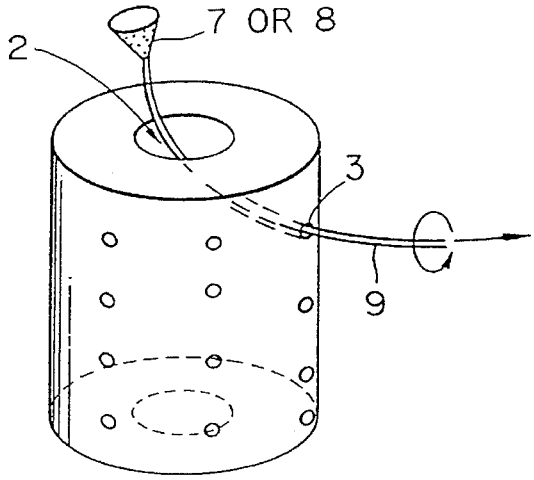
FIG. 3 illustrates a beveling process which employs a wire with the grindstone attached thereto.
Figure 4:
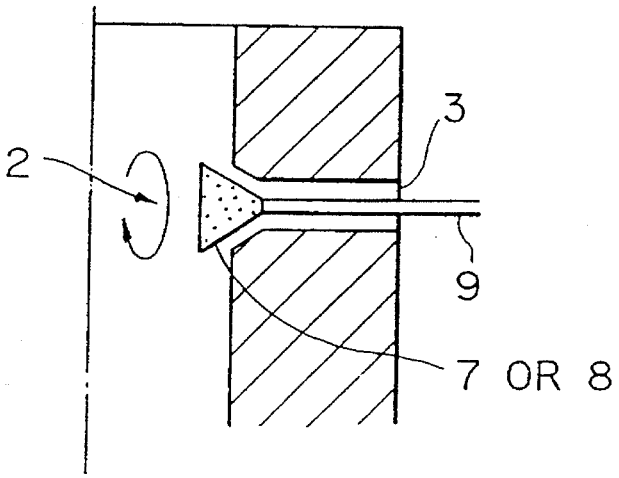
FIG. 4 is a cross-sectional view showing the beveling process which employs a wire with the grindstone attached thereto.

The chipping or edge generated around the small hole inside the parts when the small hole is formed can also be treated by beveling which is performed by passing a wire with a grinding stone attached thereto, as shown in FIG. 2(*a*) or 2(*b*), into the small hole 3 from the side of the hollow portion 2, as shown in FIG. 3, by pulling the end of a wire 9 which has protruded from the small hole, and then by rotating the grinding stone 7 or 8 while bringing it into contact with the edge of the small hole 3, as shown in FIG. 4.

In the present invention, the small holes can be formed by machining any time after molding. When ultrasonic waves or a laser is used to form small holes, the small holes can be formed any time after calcining.

The hollow portion may be finished so that it has normal dimensions preferably by using an ultrasonic machine.

When the periphery of the small hole is beveled in the form of C, a grindstone 7 shown in FIG. 2(*a*) is used as the grindstone to be mounted on the beveling wire. The surface of the grindstone 7 which makes contact with the small hole is tapered. For R beveling, a grindstone 8 shown in FIG. 2(*b*) having an R curved surface is used. The preferred size of C or R is between about 0.1 mm and 0.3 mm. A grindstone made of diamond and having a grit of about #400 is desirable.

In another preferred embodiment of the present invention, a desirable inner surface roughness of a small hole through which a cooling medium is passed is made 2 μm≦$R_{max}$≦7 μm. $R_{max}$ was measured according to JIS B 0601, using the standard values for reference lengths as explained in Section 3.3.3 of JIS B 0601.

An inner surface roughness of the small holes exceeding $R_{max}$ 7 μm reduces the strength of a ceramic to about one half of the strength of a similar body having the same diameter hole with an inner surface roughness of $R_{max}$ 0.8 μm, due to the brittleness of the ceramic material. The use of such a ceramic as a component causes breakage thereof which starts from a small hole. When the inner surface roughness of the small holes is set to 2 μm≦$R_{max}$≦7 μm, the ceramic can recover about 80% of its measured four-point flexural strength compared to the four-point flexural strength of a similar body having the same diameter hole with an inner surface roughness of $R_{max}$ 0.8 μm. Such a ceramic part having small holes can thus be used as a component.

Four-point flexural strength was measured according to JIS R 1601, with the following modifications:

Sample Size

Figure 20:
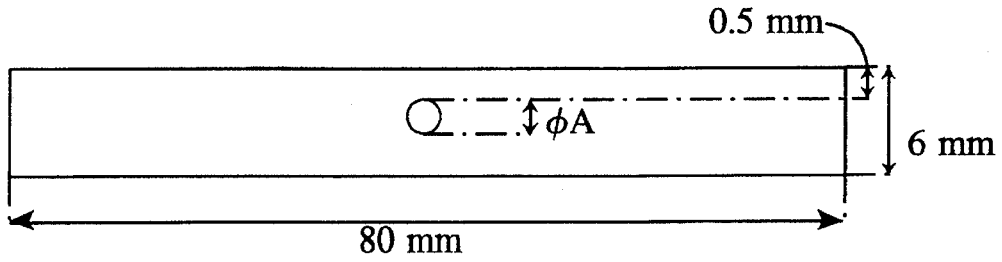
FIGS. 20(*a*) and (*b*) show the sample set-up for testing four-point flexural strength.
Figure 20:
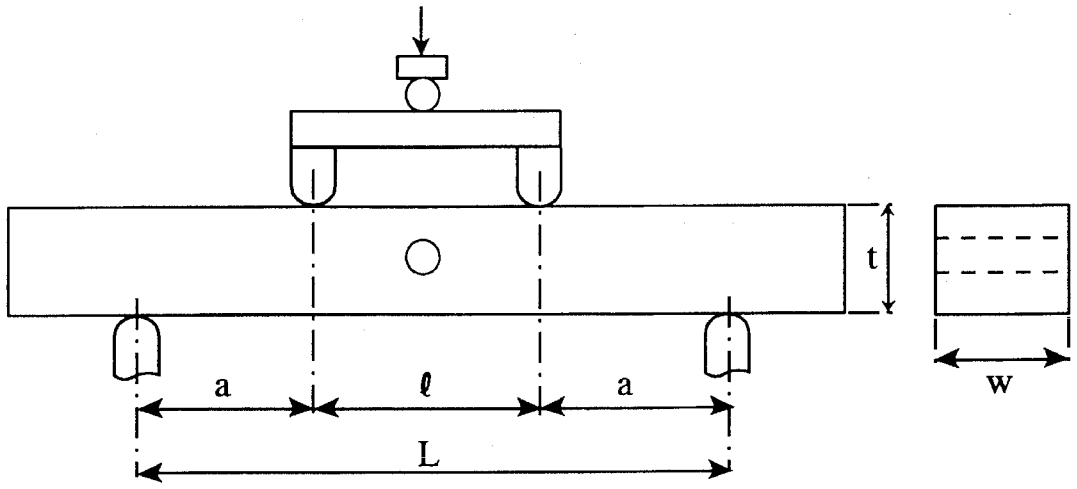

The samples were formed as rectangular bars 80 mm± 0.1 mm long, 8 mm±0.1 mm wide and 6 mm±0.1 mm thick (height), as shown in FIGS. 20(*a*)–(*b*). Each of the samples also had a hole of diameter øA passing therethrough in the width direction thereof.

Loading Points

FIG. 20(*b*) shows the loading points used in JIS R 1601. In JIS R 1601, the loading parameters L,l and a are 30 mm±0.5, 10 mm±0.5 and 10 mm±0.5, respectively. In the present case, L,l and a were set at 60 mm±0.5, 20 mm± 0.5, and 20 mm±0.5, respectively.

Aside from the above modifications, the testing parameters outlined in JIS R 1601 were used in testing samples herein.

The ceramic component according to the present invention has small holes, through which a cooling medium is passed, in given positions. Thus, when such a ceramic component is used as a gas turbine member, the gas temperature (TIT) of the turbine inlet can be increased to 1500° C. or above. Therefore, the heat efficiency can be greatly improved. Furthermore, since the heat shock which would occur in a ceramic component at a shut-down can be avoided, the reliability and life of the ceramic component can be greatly improved.

When the ceramic component according to the present invention is used as a gas turbine member, since the surface thereof is cooled by the cooling medium, it does not make direct contact with a combustion gas. Thus, erosion and corrosion can be effectively prevented.

When compared with the cooling of a metal gas turbine, the cooling of a ceramic gas turbine requires a less amount of cooling medium, thus reducing a reduction in the heat efficiency caused by cooling.

FIG. 9 is a perspective view of a turbine blade for a gas turbine showing an embodiment of the present invention. A turbine blade (a rotary blade) 10 includes a vane portion 11 and a blade foot portion 12. The turbine blade 10 for the gas turbine has small holes 3 for a cooling mechanism in given positions.

The small holes 3 provided in given positions of the ceramic parts are used for a cooling mechanism, and circulate a cooling medium therethrough. Any type of cooling medium can be used. Examples of such cooling media include air and water.

Any known ceramic material can be used in the present invention. For example, alumina, silicon nitride, silicon carbide, partially stabilized zirconia, and stabilized zirconia can be used. Particularly, silicon nitride, silicon carbide and partially stabilized zirconia, which are hard to grind, are effectively used.

Figure 10:
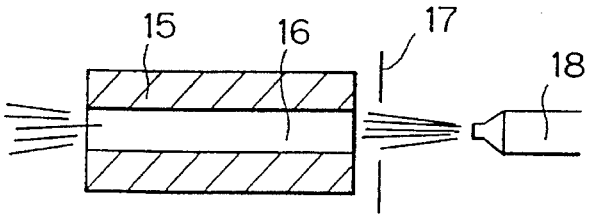
FIG. 10 illustrates an example of a method of polishing the inner surface of a small hole in a ceramic part.

The inner surface of the small hole for a cooling mechanism, formed in the ceramic parts according to the present invention, is polished in any of the following manners. Is the first method, a through-hole 16 having a diameter of 2 mm is opened in a ceramic molded part obtained from silicon nitride, as shown in FIG. 10. After a masking 17 is performed on the outside of the small hole 16, the inner surface of the through-hole 16 is sandblasted under a pressure of 5 kg/cm$^2$ by a sandblaster which employs abrasive grains of GC#800.

Figure 11:
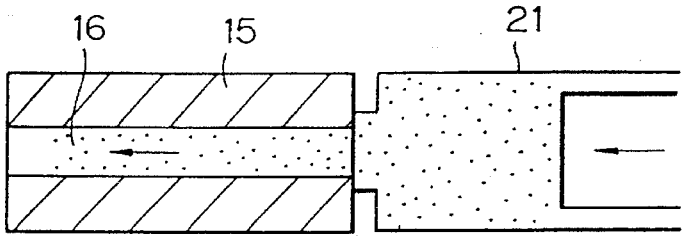
FIG. 11 illustrates another example of the method of polishing the inner surface of the small hole in a ceramic part.
Figure 12:
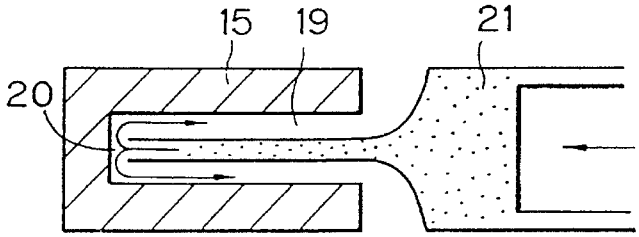
FIG. 12 illustrates still another example of the method of polishing the inner surface of the small hole in a ceramic part.

Alternatively, the inner surface of the small hole 16 opened in the same ceramic molded parts 15 as that shown in FIG. 10 may be polished by extruding an abrasive grain mixture into the through-hole 16 under a pressure of 10 kg/cm$^2$ from a cylinder 21 (called the abrasive grain extruding method), as shown in FIG. 11. The abrasive grain mixture consists of diamond powder and clay having a grit of 4 μm, which are mixed at a weight ratio of 1:10, and water is added. Regarding a blind small hole 19 formed in the ceramic molded parts 15, as shown in FIG. 12, the inner surface thereof may be polished by extruding the abrasive grain mixture from a distal end 20 of a nozzle of the cylinder 21 by the same abrasive grain extruding method as that shown in FIG. 12.

In the ceramic part having small holes according to the present invention, since there is no chipping or edge around the small hole which can cause breakage under a high pressure and at a high temperature, the strength of the ceramic part can be greatly improved as compared with a conventional ceramic part.

Also, the ceramic part according to the present invention is suitable for use at a high temperature of 1000° C. or above, and can thus be used as a gas turbine member, such as a turbine blade or a turbine nozzle for a gas turbine.

The desirable diameter of the small hole for the cooling mechanism through which a cooling medium is circulated is 3 mm or below from the view point of the strength of the ceramic part. The hole preferably has a diameter of 2 mm or less, with a lower limit of 0.2 mm, more preferably 0.3 mm.

The present invention is hereinafter described more in detail with reference to Examples. However, the present invention is not limited to these examples.

EXAMPLE 1

A molded compact of a gas turbine combustor nozzle was obtained by injection molding a mixture of $Si_3N_4$ of 50% by weight and paraffin types wax of 50% by weight. In this compact, a hollow portion was formed such that it had dimensions smaller than the normal dimensions after calcining. After degreased for 1 hour at 500° C., the molded compact was compressed under a pressure of 5 ton/cm$^2$ by the cold isostatic pressure molding (CIP), and then calcined for 1 hour at 1300° C.

Next, the obtained calcined compact was drilled by a drilling machine (whose rotational speed was 50 rpm) to form small holes having a diameter of 1.0 mm. During this drilling operation, a chipped area was generated around the small hole when the small hole penetrated the calcined compact.

After drilling, the hollow portion was finished such that it had the normal dimensions using an ultrasonic machine (frequency: 16 kHz, amplitude: 10 μm, abrasive grains of SIC#400 were used) to remove the chipped portion.

Subsequently, the ceramic body was fired for 1 hour at 1900° C., and then finished by machining to obtain a combustor nozzle having small holes for a ceramic gas turbine.

EXAMPLE 2

A molded compact of a gas turbine combustor nozzle was obtained by injection molding of a mixture of $Si_3N_4$ of 50% by weight and paraffin type wax of 50% by weight. After degreased for 1 hour at 500° C., the compact was compressed under a pressure of 5 ton/cm$^2$ by the cold isostatic pressure molding (CIP), and then calcined for 1 hour at 1300° C.

After fired for 1 hour at 1900° C., the ceramic body was drilled using an ultrasonic machine (frequency: 16 kHz, amplitude: 10 μm, abrasive grains of SIC#400 were used) to form small holes having a diameter of 0.8 mm. Next, beveling was performed to treat the chipping or edge generated around the small hole when the small hole was formed by using a wire with a conical diamond grindstone attached thereto. The diameter of the wire was 0.5 mm. The diameter of the bottom surface of the grindstone was 3 mm. The size of C of the grindstone was 1.2 mm, and the grit of the grindstone was #400. The wire was passed into the small hole from the hollow portion side, and the portion of the wire which was protruded from the small hole was pulled and rotated with the grindstone brought into contact with the periphery of the small hole for beveling.

Finally, the ceramic body was finished by machining to obtain a combustor nozzle having small holes for a ceramic gas turbine.

EXAMPLE 3

A combustor nozzle having small holes for a ceramic gas turbine was obtained in the same manner as that of Example 2 with the exception that a YAG laser (output: 20 kw, the feed speed: 0.5 mm/sec) was used to form the small holes.

Evaluation Test of the Edge Portion of Test Pieces

Four-point flexural strength tests were conducted on the test pieces. The strength of the test pieces which had a chipped area was about 50% of the normal one. Also, variance of the strength was great. Some of the test pieces broke at a low value. The test pieces which were beveled in the form of C had a stable strength, and variance of the strength was less.

EXAMPLE 4

Figure 13:
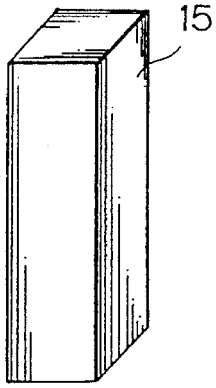
FIG. 13 is a perspective view of a ceramic molded part.

Three types of ceramics (material A had a composition of $ZrO_2$, material B had a composition of $Si_3N_4$, and material C had a composition of SiC) were used. After a sintering agent was added to each of the materials, each material was mixed. Thereafter, a binder was added to each of the materials, and each material was kneaded to obtain three kinds of molding materials. Each of the obtained molding materials was filled in a mold, and then pressed under a pressure of 500 kg/cm$^2$ to obtain a ceramic compact 15 shown in FIG. 13. Thereafter, each of the ceramic compact 15 was subjected to cold isostatic pressure molding (CIP) under a pressure of 5 ton/cm$^2$. Each of the molded parts was calcined in the air at 500° C. to remove the binder, and was then fired in nitrogen gas at 1900° C. Next, each of the obtained sintered parts was drilled by a drilling machine to open a through-hole 16 having a diameter of 2 mm, shown in FIG. 14, or a blind small hole 19 having a diameter of 2 mm, shown in FIG. 15. The inner surface of each of the small holes was polished by sandblasting or the abrasion grain extruding method and thereby finished to obtain the test sample having given dimensions.

Regarding the obtained test samples, the surface roughness of the inner surface of the through-hole 16 or the blind small hole 19 was changed. The four-point flexural strength of each of the samples was measured. The results of the measurements are shown in FIG. 16.

Figure 16:
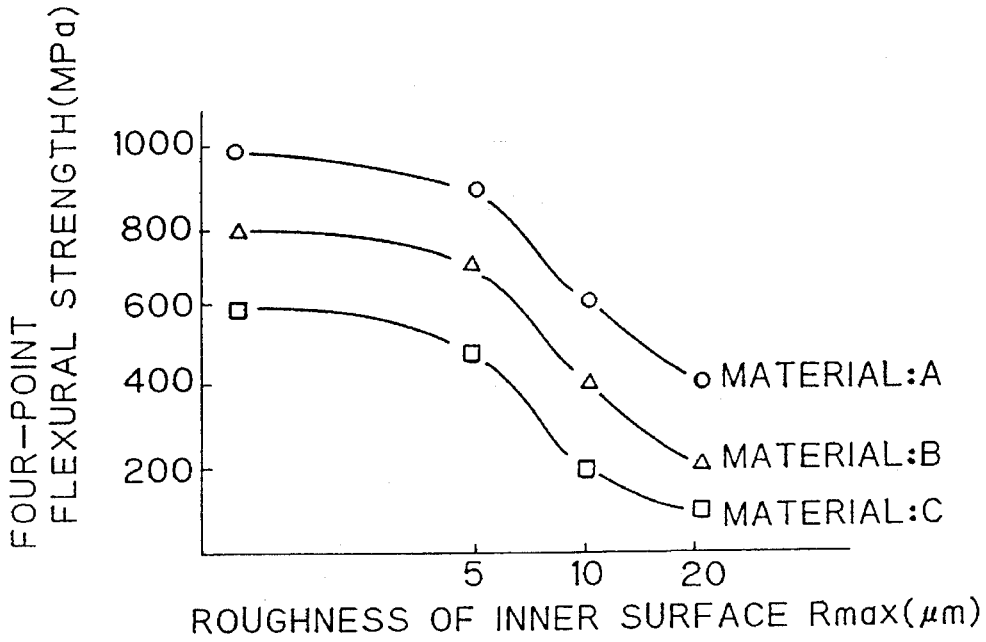
FIG. 16 is a graph showing the relation between the roughness of the inner surface of the small hole(s) in a fired body and the four-point flexural strength.

It can be seen from FIG. 16 that the strength is improved when the surface roughness of the inner surface of the small through-hole is 2 μm$\leqq R_{max} \leqq$7 μm and that the strength reduces when the surface roughness exceeds $R_{max}$ 7 μm. It can also be seen that the maximum surface roughness of the inner surface of 2 μm$\leqq R_{max} \leqq$7 μm assures about 80% of the strength of a similar body having the same diameter hole with an inner surface roughness of $R_{max}$ 0.8 μm. JIS R 1601 recognizes in Section 4.3 thereof that surface roughness of the external surface of a ceramic test piece affects the four-point flexural strength of the test piece. JIS R 1601 also implies that a surface roughness of $R_{max}$ 0.8 μm will not affect the strength test results of the samples. Accordingly, the first data points tested in each of the materials reported in FIG. 16 are at 0.8 μm $R_{max}$ for the surface roughness of the inner surface of the hole.

EXAMPLE 5

Figure 14:
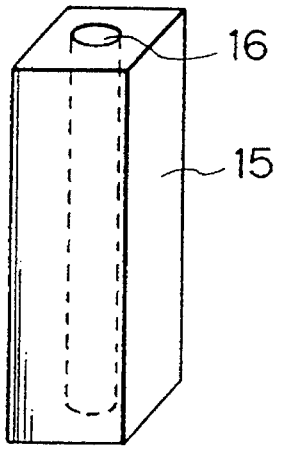
FIG. 14 is a perspective view of a ceramic molded part having a small through-hole.
Figure 15:
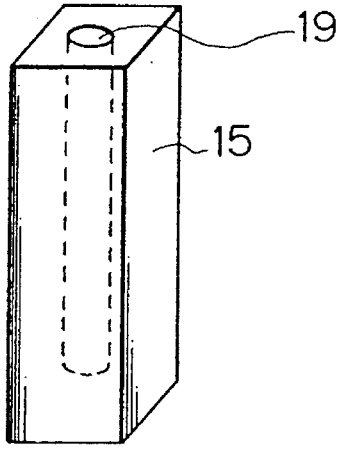
FIG. 15 is a perspective view of a ceramic molded part having a small blind hole.

Among the test samples obtained in Example 4 and having the small through-hole 16 of a diameter of 2 mm shown in FIG. 14, some of them were heat treated after polishing. Four-point flexural tests were conducted on both types of test samples which were just polished and which were heat treated after polishing. The results of the test are shown in FIG. 17.

Figure 17:
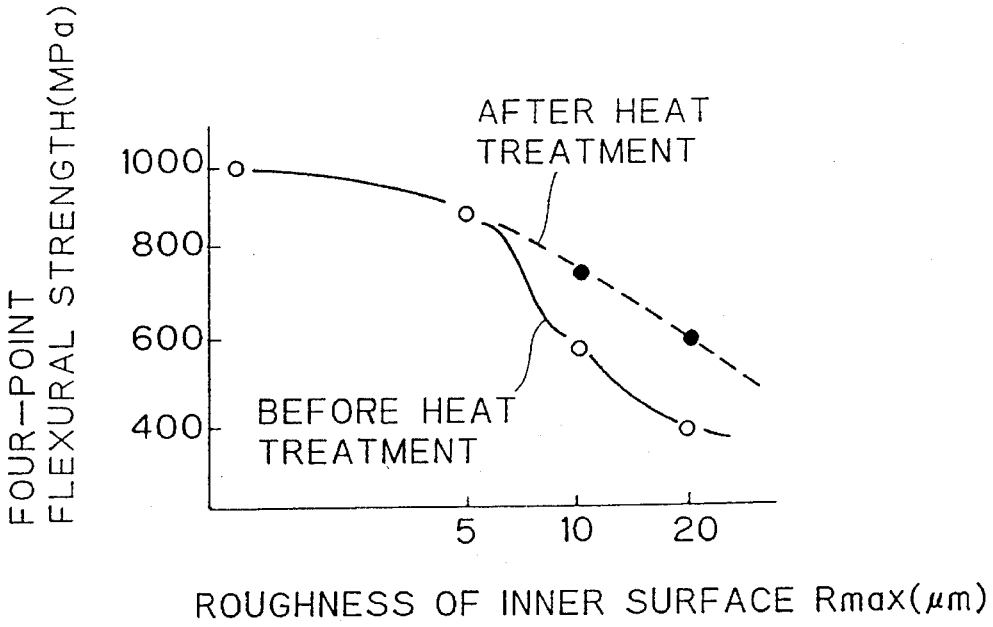
FIG. 17 is a graph showing the relation between the roughness of the inner surface of the small hole(s) in a fired body and the four-point flexural strength which is obtained before and after the heat treatment.

It can be seen from FIG. 17 that the heat treatment conducted after the inner surface of the small hole was polished reduces the distortion generated by drilling the sintered body or by polishing the inner surface of the small hole and can thus recover the strength of the material.

EXAMPLE 6

Figure 18:
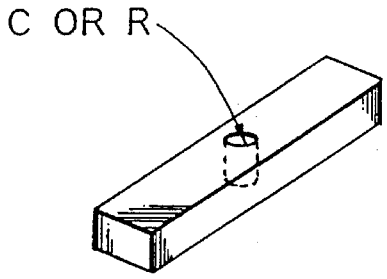
FIG. 18 is a perspective view of a test sample having a small hole.
Figure 19:
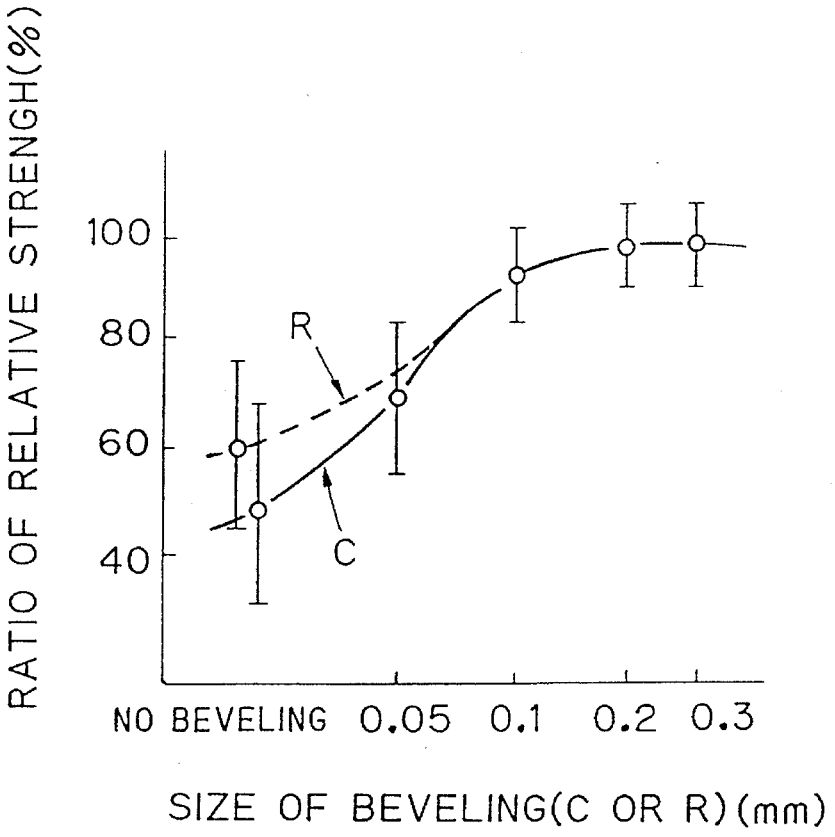
FIG. 19 is a graph showing the relation between the size of beveling (C or R) and the ratio of relative strength.

Test samples having a small hole with a diameter of 2 mm shown in FIG. 18 were prepared. The test samples were treated so as to have various conditions of edge treatment in order to evaluate mechanical reliability of the portion around the hole of each of the sample. The four-point flexural strength of each of the samples was measured. The results of the measurements are shown in FIG. 19.

The X-axis represents the size of beveling (c or R), and the Y-axis represents the ratio(%) of relative strength (ratio of four-point flexural strength to the strength inherent in the material). It can be seen from FIG. 19 that the samples without edge treatment had variance of the ratio of the strength, and some of them at a low value. The strength of some of the test pieces which had a chipped area was lower than 50%. The size of C or R of beveling was made larger. By beveling C or R larger than 0.1 mm, variance of the strength can be reduced and samples having the ratio of relative strength of at least 80%.

EXAMPLE 7

Several samples are made in accordance with the process of Example 1, and are formed in the shape of rectangular bars 80 mm long, 8 mm wide and 6 mm thick. Each sample has a 2 mm diameter hole formed therethrough in the direction of width thereof, as shown in FIG. 20(*a*). Each sample is made of silicon nitride.

The surface roughness of the inner surface of the hole formed in each sample is varied according to the following Table, and the four-point flexural strength of each sample is then measured and reported in the following Table.

| $R_{max}$ (μm) | Four-point Flexural Strength (kgf) |
|---|---|
| 0.8 | 100 ± 18 |
| 2 | 98 ± 15 |
| 4 | 89 ± 9 |
| 6 | 86 ± 11 |
| 7 | 82 ± 9 |
| 10 | 65 ± 25 |
| 20 | 37 ± 18 |

The variations in four-point flexural strength range from 9 to 25 kgf, wherein one kgf is equivalent to 9.8N. The variations in strength can depend on factors such as sample number.

The above samples show the significance of maintaining the surface roughness of the inner surface of the hole formed in the ceramic body within 2 μm≦$R_{max}$ 7 μm. Although it is fully expected that a surface roughness less than 2 μm would result in even higher four-point flexural strength values, it is very time-consuming, and thus expensive from a manufacturing standpoint, to polish the inner surface of such small holes in ceramic bodies to such a low degree of surface roughness.

As will be understood from the foregoing description, in the present invention, when the surface roughness of the inner surface of the small hole formed in a ceramic parts to circulate a cooling medium is set to 2 μm≦$R_{max}$≦7 μm or below, even when that ceramic part is used as a component, it can recover about 80% of the strength of a similar body having the same diameter hole with a surface roughness of 0.8 μm. This makes the ceramic part to be used reliable as a high-temperature resistant component.

What is claimed is:

1. A ceramic body comprising:

at least one material selected from the group consisting of silicon nitride, silicon carbide, and partially stabilized zirconia; and at least one hole formed in said ceramic body, said hole having a diameter of not more than 3 mm, with the surface roughness $R_{max}$ of the inner surface of said hole being 2 μm≦$R_{max}$≦7 μm, whereby said body has a measured four-point flexural strength of at least about 80% of that of a similar body having the same diameter hole with an inner surface roughness of $R_{max}$ 0.8 μm.

2. The ceramic body of claim 1, wherein said hole has a diameter of at least 0.2 mm.

3. The ceramic body of claim 1, wherein said hole has a diameter of at least 0.3 mm.

4. The ceramic body of claim 1, wherein said body consists essentially of silicon nitride.

5. The ceramic body of claim 1, wherein said small hole has a beveled edge portion.

6. The ceramic body of claim 1, further comprising a hollow portion formed in said ceramic body, said at least one hole extending from said hollow portion to an exterior of said ceramic body, and an edge portion of said hole being beveled.

7. The ceramic body of claim 1, wherein said hole has a diameter ≦2 mm.

* * * * *